US005383303A

United States Patent [19]

Nakanishi et al.

[11] Patent Number: 5,383,303

[45] Date of Patent: Jan. 24, 1995

[54] WINDOW

[75] Inventors: Yoshikazu Nakanishi; Kenkichi Matsubara; Tamotsu Nakazawa, all of Tokyo, Japan

[73] Assignee: Nakanishi Engineering Co., Ltd., Tokyo, Japan

[21] Appl. No.: 926,038

[22] Filed: Aug. 5, 1992

[30] Foreign Application Priority Data

Dec. 4, 1991 [JP] Japan ..... 3-47683

[51] Int. Cl.[6] ..... E05D 15/22

[52] U.S. Cl. ..... 49/181; 49/175; 49/445

[58] Field of Search ..... 49/181, 176, 445, 446, 49/175, 174; 16/197

[56] References Cited

U.S. PATENT DOCUMENTS

| | | | |
|---|---|---|---|
| 1,762,993 | 4/1929 | Klemm . | |
| 2,792,588 | 5/1957 | Gency | 16/197 |
| 2,890,480 | 6/1959 | Gregg et al. | 16/197 |
| 3,055,062 | 9/1962 | Peters et al. . | |
| 3,434,236 | 3/1969 | Weidner et al. . | |
| 3,452,478 | 7/1969 | Foster . | |
| 3,844,066 | 10/1974 | Nobes . | |
| 4,854,077 | 8/1989 | Rogers et al. | 49/181 X |
| 5,035,081 | 7/1991 | Yamamoto et al. | 49/175 X |

FOREIGN PATENT DOCUMENTS

| | | |
|---|---|---|
| 194886 | 12/1987 | Japan . |
| 8367 | 1/1988 | Japan . |
| 57288 | 5/1991 | Japan . |

*Primary Examiner*—Philip C. Kannan
*Attorney, Agent, or Firm*—Emmanuel J. Lobato

[57] ABSTRACT

A window constructed such that a window sash is slidable upwardly and downwardly along a side jamb of a window, and may be inclined relative to the side jamb. The window sash is hung by a counterbalance and held at a selected desired position. The counterbalance is provided with a coiled torsion spring which counter balances the window sash, and the torsion force of the torsion spring can be adjusted. Adjusting mechanism is provided with a rotatable adjusting shaft for adjusting the torsion force of the torsion spring, a braking member for applying braking force to the adjusting shaft to prevent the rotation of the adjusting shaft, and a cam face for urging the braking member against the adjusting shaft to brake it or release it.

21 Claims, 14 Drawing Sheets

WINDOW

BACKGROUND OF THE INVENTION

The present invention relates to a window in which a window sash is slidable upwardly and downwardly along side jambs of a window frame, and adapted to downward swinging toward the inside of the window frame. In a prior art, a counterbalance is employed to hold a window sash at a desired vertical position. As the counter balance, it is known that torsion force of a coiled torsion spring is used for counter balancing the window sash. To adjust the torsion force, there are known several mechanical structures wherein an adjusting shaft is restricted to rotate in one direction by a ratchet mechanism, or a braking force is applied to the adjusting shaft by resilient force of a coiled brake spring.

The former using the ratchet mechanism as mentioned above is convenient for winding the torsion spring, but inapplicable to unwinding it, whereby the torsion force can not be adjusted properly. The latter using the brake spring is applicable to the both of winding and unwinding of the torsion spring. However, due to unreliability of the braking force of the brake spring and reduction of the braking force by deterioration of the brake spring, the wound torsion spring is unwound naturally, which leads to out of use. Further, the winding and unwinding operations of the torsion spring are not made smoothly, and also the brake spring is not assembled readily.

Further, in a window in which the up-and-down slidable window sash is rotated from a vertical position to a horizontal position, there is known the use of a counter balancing apparatus comprising a counter balancing means for the window sash, and a braking means for applying a braking force to the window sash as the window sash is being inclined, to position it at a set inclined position.

In this counter balancing apparatus, the counter balancing means has no adjusting means for the counter balancing force, and thus it is impossible to adjust the counter balancing means after the counter balancing means and the window sash are assembled in the window frame, or to adjust the fluctuation of the force by the counter balancing means during operation.

In addition, there is known a window in which a sliding member is mounted on a side jamb of a window frame in an up-and-down slidable fashion, the sliding member is connected to the lower end of the window sash with a horizontal shaft such that the window sash would be swung inwardly in a horizontal direction, each of both sides of the window sash is connected to the sliding member with an arm to hold the window sash at a desired rotation angle in an inward direction, and a counter balancing means is disposed to hang the sliding member therefrom to hold the sliding member at a desired height.

The above arm is already connected undetachably to both the window sash and the sliding member which is slidable up-and-down within the side jamb of the window frame when such a window is made in a factory, and thus it is unavoidable to transport the window in a situation in which the window is assembled on the window frame, and this is inconvenient. Further, the counter balancing means can not be replaced readily after installation of the window, the downward swingable angle of the window sash toward the inside is restricted to a small angle for prevention of crimes, and when the area of the window sash is large the outside face of the window sash can not be cleaned readily.

SUMMARY OF THE INVENTION

It is an object of the present invention to provide a window provided with a counter balancing apparatus having a counter balancing means for an up-and-down slidable window sash, wherein adjustment of the counter balancing force is made securely, readily and smoothly.

It is another object of the present invention to provide a window provided with a counter balancing apparatus wherein the counter balancing force is maintained securely for a long period of time.

It is still another object of the present invention to provide a window provided with a counter balancing apparatus wherein adjustment of the counter balancing means is made with the window sash and the counter balancing means assembled in a window frame.

It is a further object of the present invention to provide a window provided with a convenient counter balancing apparatus wherein braking force is automatically applied to the window sash as the window sash is being inclined, whereby the counter balanced state of the window sash is maintained.

It is a still another object of the present invention to provide a window which is readily transported to a site for installation from a factory while the window sash and the window frame are separated.

It is another object of the present invention to provide a window wherein the counter balancing means is readily replaced even after installation of the window sash.

It is still another object of the present invention to provide a window wherein the outside surface of the window sash is cleaned readily even though the downward swinging angle of the window sash is restricted to a small angle.

It is a further object of the present invention to provide a window provided with a counter balancing apparatus in which the construction is simple, and the manufacturing and assembling are made readily.

To accomplish the above-mentioned objects, the present invention provides a counter balancing apparatus comprising a counter balancing means having a coiled torsion spring to counterbalance a window sash; a first sliding block connecting the counter balancing means to the window sash and guiding the window sash upwardly and downwardly along a side jamb of a window frame; an adjusting means incorporated in the first sliding block for adjusting the counter balancing force by a torsion spring; the adjusting means being comprised of an adjusting shaft for the counter balancing force of the torsion spring, a braking member for the adjusting shaft, and a cam face for operating a braking member. This counter balancing apparatus further comprises a braking means for braking automatically the sliding block as the window sash is being inclined forwardly or rearwardly. Further, an arm, which maintains the window sash at a predetermined angle, is detachably connected to a second sliding block which is slidable within a side jamb of the window frame.

BRIEF DESCRIPTION OF THE DRAWINGS

The present invention will now be described with reference to the accompanying drawings, in which.

DETAILED DESCRIPTION OF THE PREFERRED EMBODIMENTS

Figure 1:
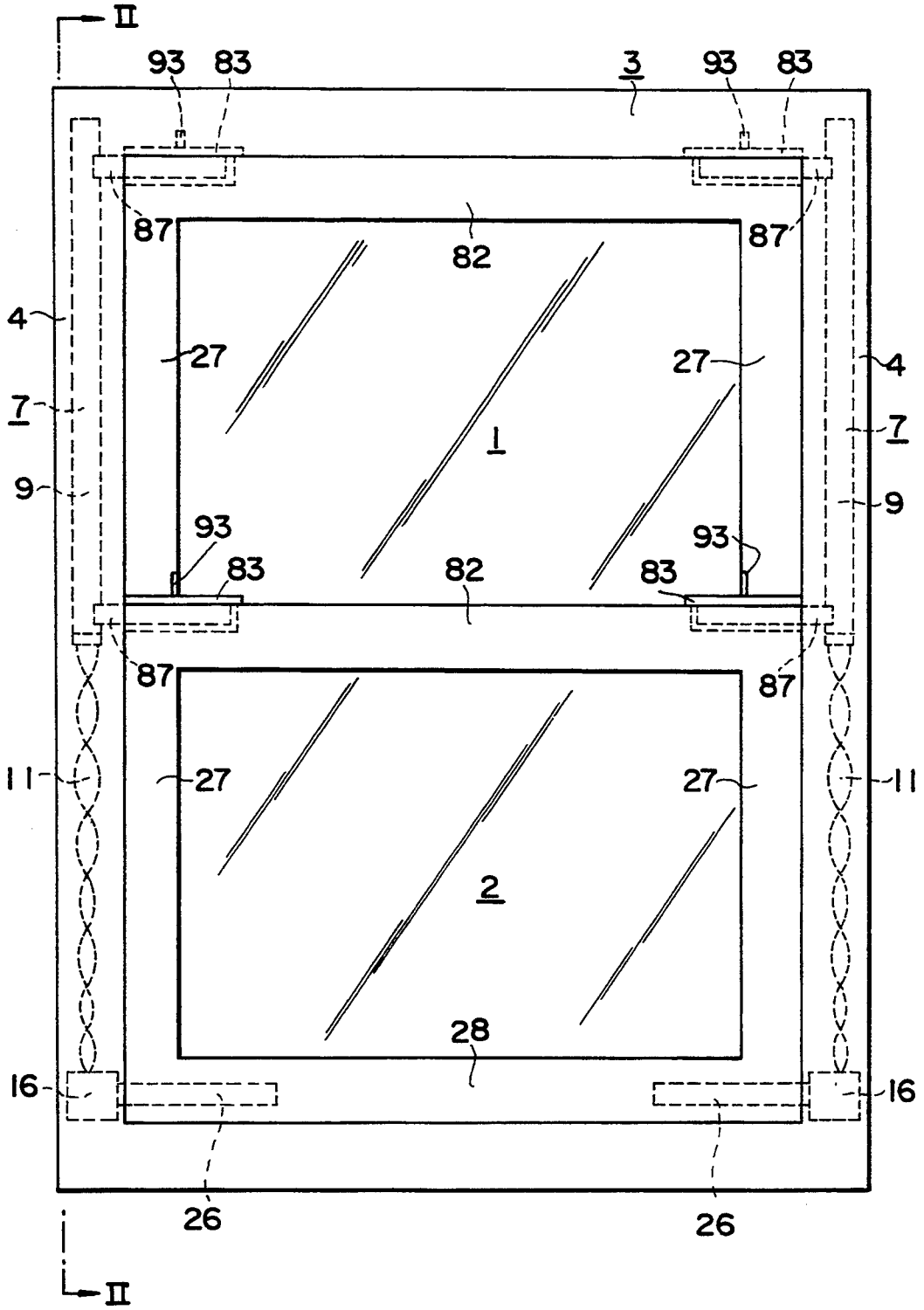
FIG. 1 is a front elevation view of a window embodying the present invention.
Figure 2:
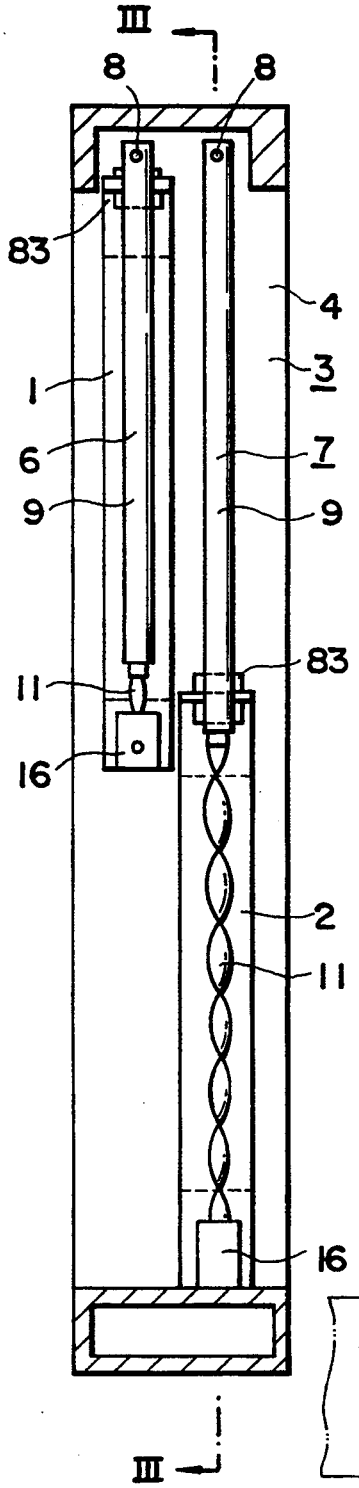
FIG. 2 is a sectional view taken along section line II—II of FIG. 1.

An outer window sash 1 and an inner window sash 2 move upwardly and downwardly along guide grooves 5, 5 of side jambs 4 of a window frame 3 (FIGS. 1 and 11), and the outer window sash closes the upper portion of a window and the inner window sash closes the lower portion of the window. Respective window sashes 1, 2 are hung within the side jambs 4 under a counter balanced condition by counterbalances 6, 7 used as counter balancing means (FIG. 2), respectively, whereby the sashes are held at a desired height. Respective window sashes 1, 2 are permitted to rotate toward the inside of a room at a predetermined angle. Hereinafter, description will be made mainly with respect to the inner window sash 2.

The counterbalances 6, 7 have the same structures provided that the dimensions thereof are different from each other such that each of them may be adapted for the inner or outer sash 1 or 2, whereby the following description will be made mainly with respect to the one counterbalance 7 for the inner sash 2.

The counterbalance 7 is provided with a tube 9 extending in upper and lower directions, wherein the upper end is connected to the side jamb 4 by means of a pin 8 (FIGS. 2 3); a nut 10 is connected to the lower end of the tube in such a manner that the nut is permitted to be only rotatable; a rotatable spiral member 11 movable up-and-down is disposed in the tube, and the lower end portion of the spiral member passes through the nut 10 engaging it and projects axially thereof and from the lower end of the tube 9. A coiled torsion spring 15 having an upper end 13 wound around the spiral member 11 within the tube 9 and fixed to the tube 9 with a spring lock member 12, has a lower end 14 fixed to the nut 10. The spiral member 11 rotates nut 10 by the downward movement to wind the torsion spring 15, and the wound torsion spring 15 rotates the nut 10 in a reverse direction by the unwinding force to raise the spiral member 11. The spiral member 11 is connected to the sashes 1, 2, and the torsion spring 15 is applied with a torsion force which counter balances the sash 2 at its maximum raised position, whereupon the torsion spring 15 always counter balances the sash, and thus holds the sash at a position of a desired height, and can move the sash upwardly and downwardly by a small force.

Figure 5:
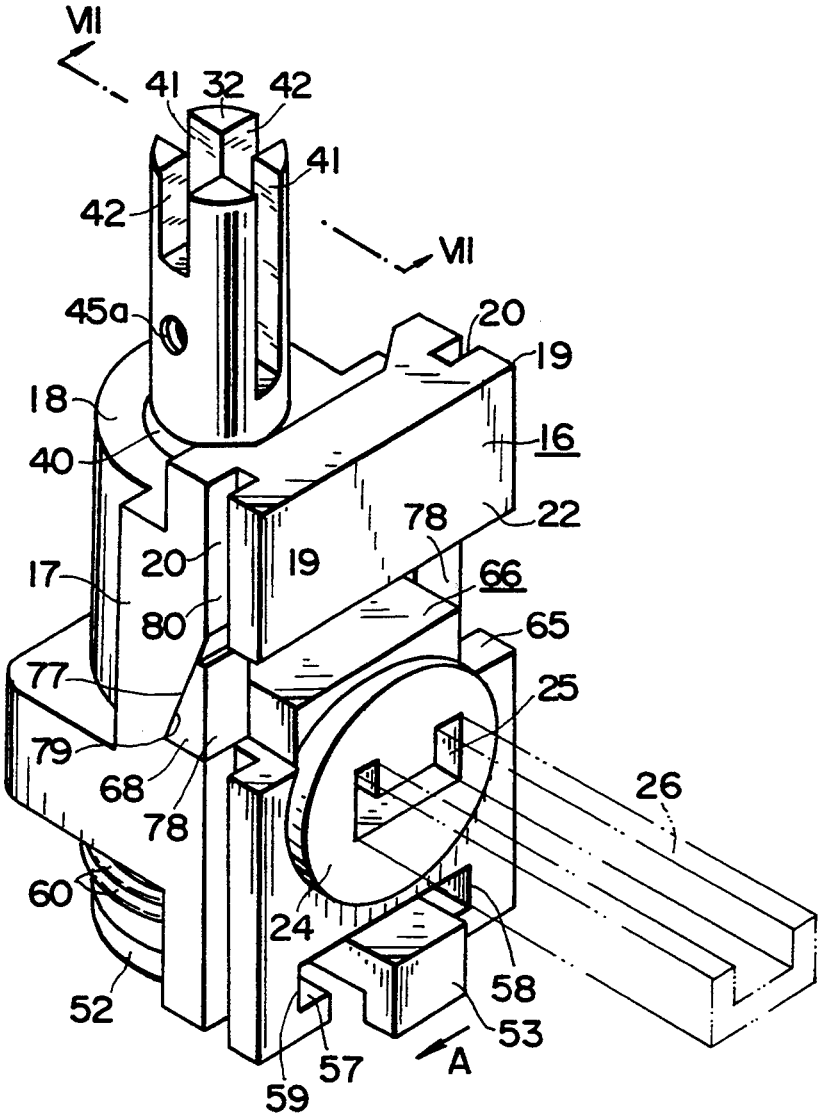
FIG. 5 is a perspective view shown from the right hand, showing in assembled condition of a first sliding block, an adjusting means of a torsion spring, and a braking means for the first sliding block.
Figure 6:
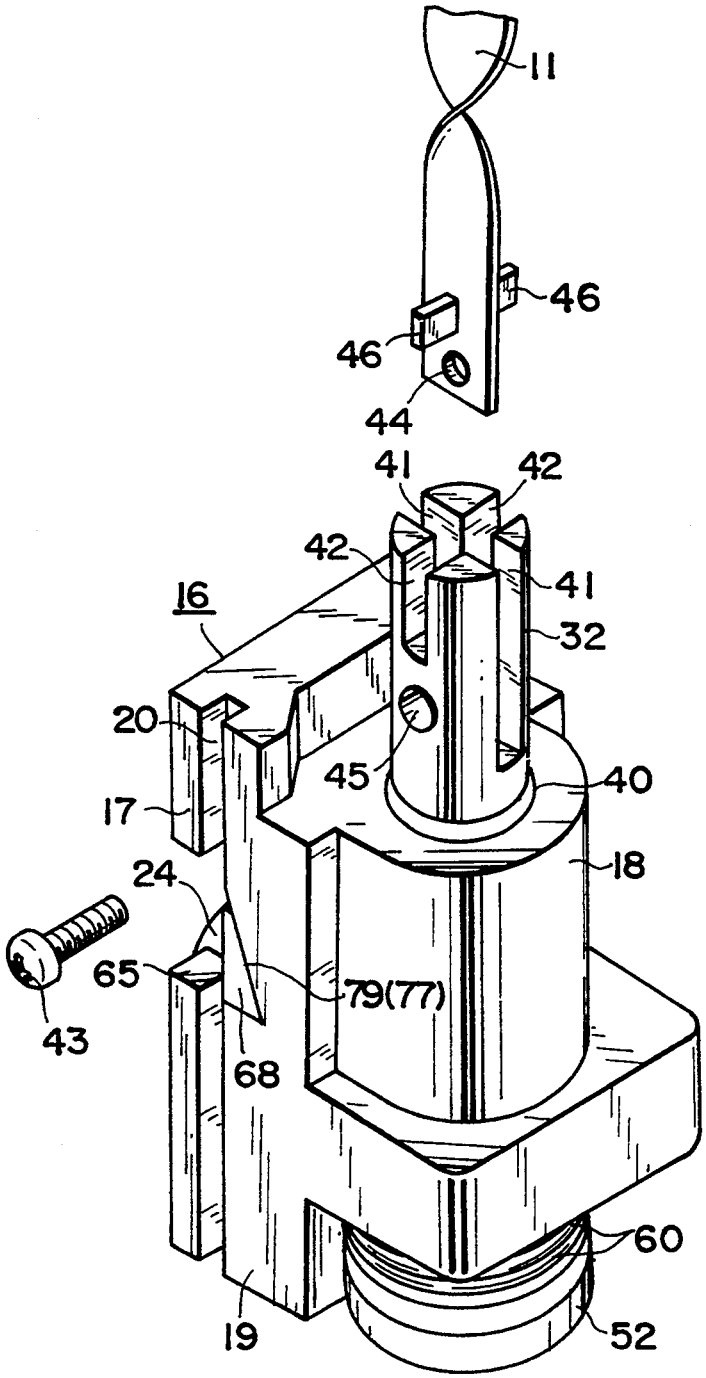
FIG. 6 is a perspective view shown from the left hand, illustrating assembled condition of a first sliding block, an adjusting means of a torsion spring, and a braking means for the first sliding block.
Figure 8:
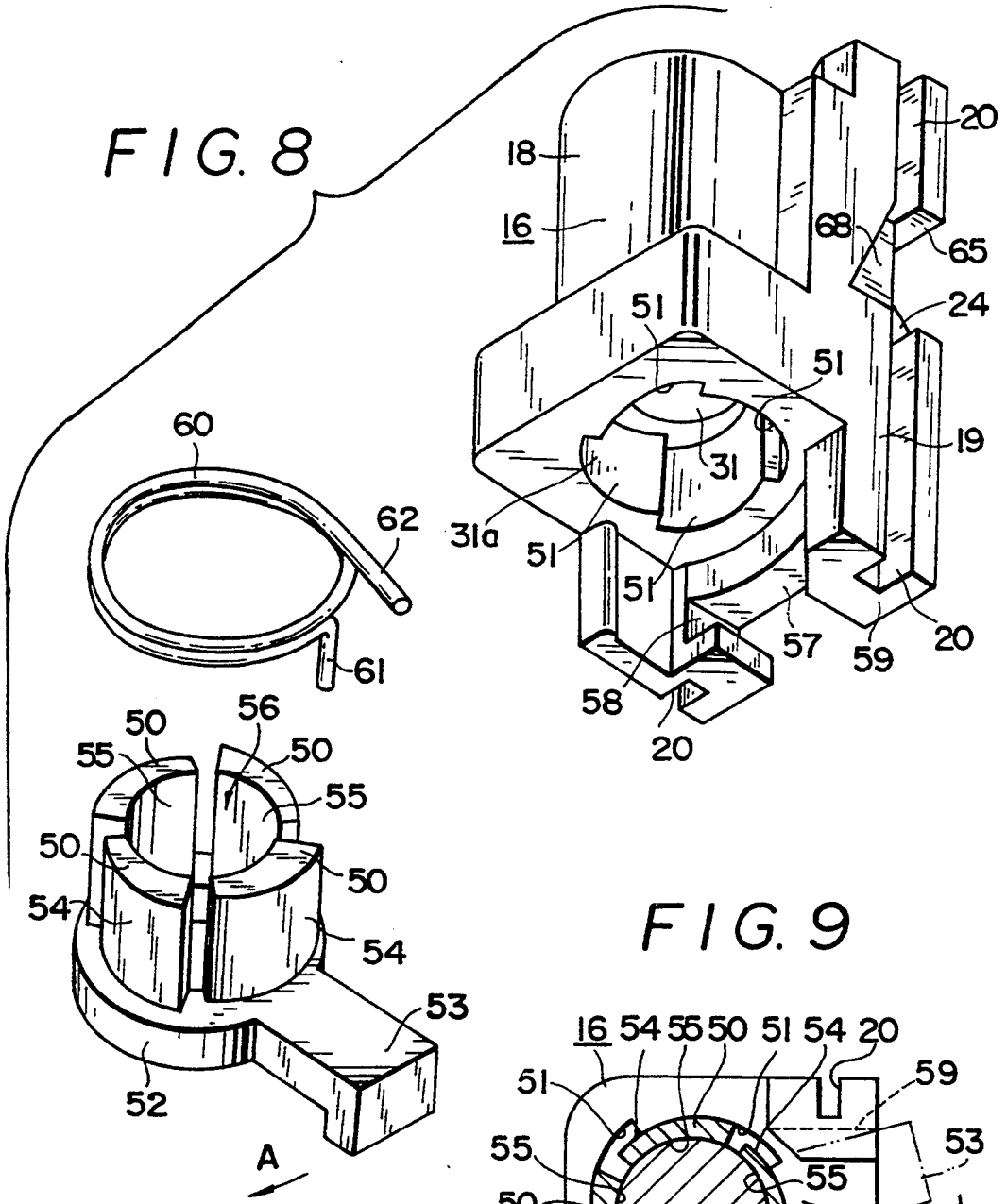
FIG. 8 is an exploded perspective view showing an adjusting means for the torsion spring.

A first sliding block 16 is mainly comprised of a substantially rectangular portion 17, and a cylindrical portion 18 formed integrally with said portion, and is incorporated slidably within the guide groove 5 of the side jamb 4 of the window frame (FIGS. 5, 6 and 8).

Figure 15:
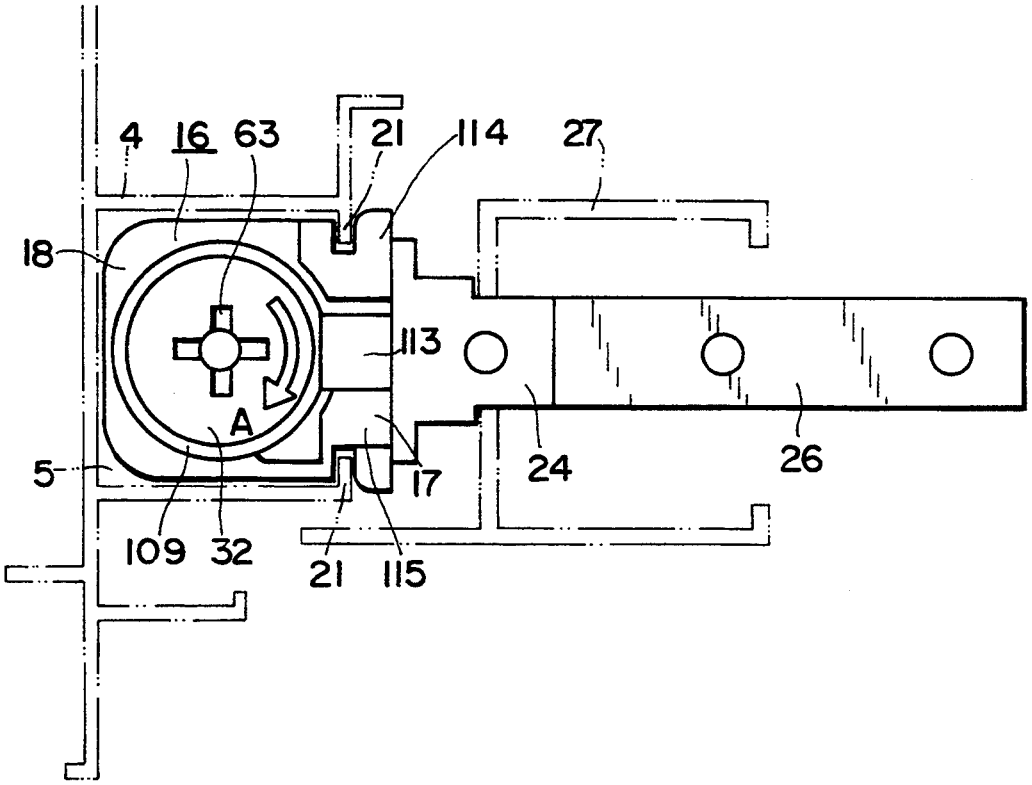
FIG. 15 is a bottom end view of FIG. 13.

The rectangular portion 17 has a sliding groove 20 extending in upward and downward directions, formed on a flat surfaces 19 being parallel to each other at the both sides of the portion (FIG. 5). The sliding groove 20 is slidably fitted with a flange 21 at the aperture of the guide groove 5 of the side jamb 4 (FIGS. 12 and 15) to move the sliding block 16 upwardly and downwardly along the guide groove 5.

Figure 4:
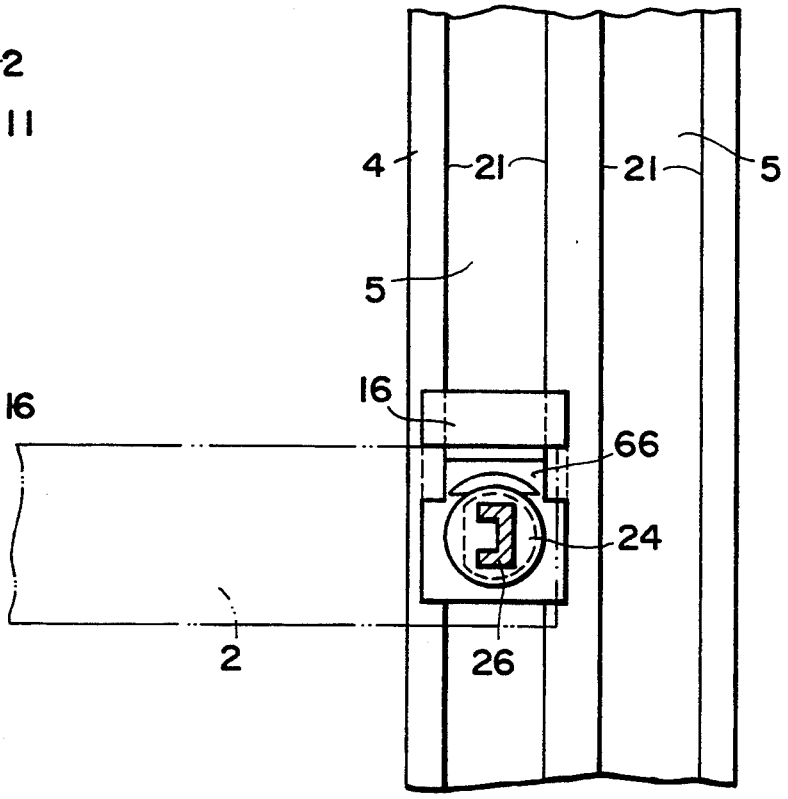
FIG. 4 is a sectional view taken along section line IV—IV of FIG. 3, illustrating the inner window sash downwardly swung to the inside.
Figure 7:
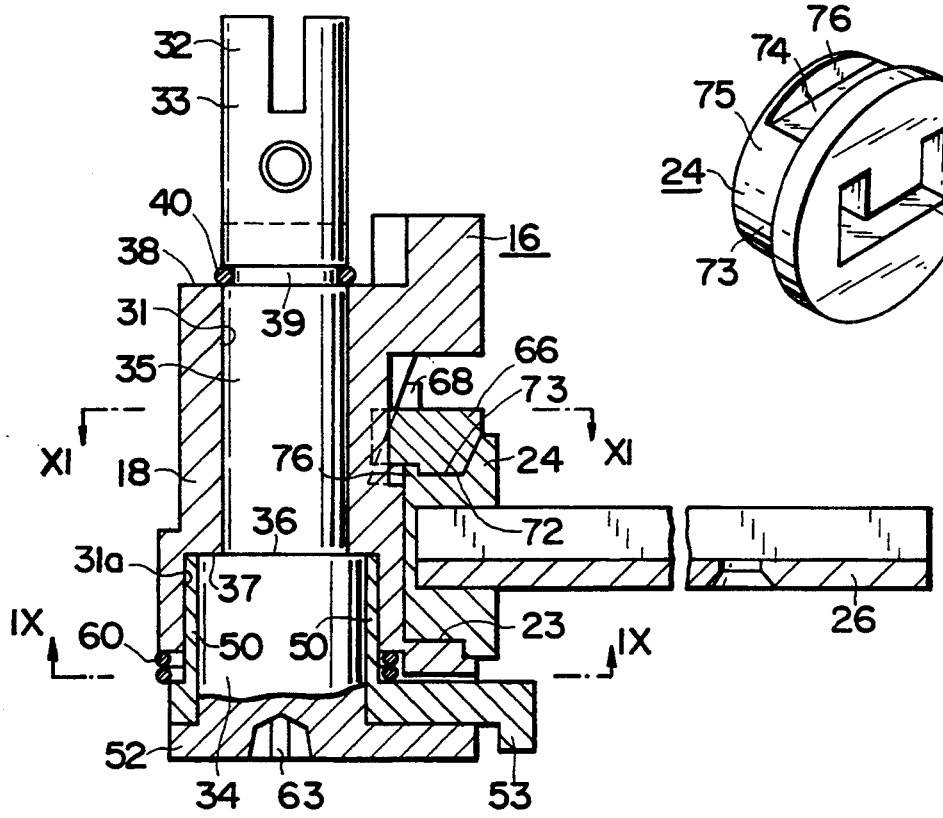
FIG. 7 is a sectional view taken along section line VII—VII of FIG. 5.
Figure 7:
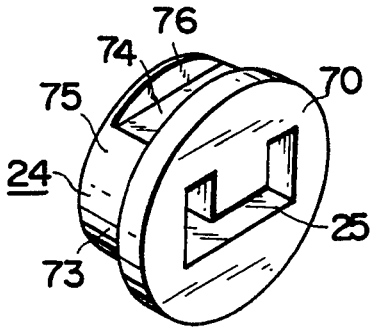

The rectangular portion 17 also has a shaft supporting bore 23 disposed horizontally on a flat surface 22 which is perpendicular to the flat surfaces 19 at the both sides of the portion (FIG. 7). The shaft supporting bore 23 supports rotatably a pivot shaft 24, and the pivot shaft 24 has a connecting opening 25 which is fitted with a connecting arm 26 such that the shaft would be rotated integrally with the connecting arm 26 (FIG. 5). The connecting arm 26 is fixed to a bottom rail 28 of the sash 2 (FIG. 3), and the sash is inclined from the vertical position to the horizontal position toward the inside of the room around the pivot shaft 24 as a rotation center (FIG. 4). By this inclining movement, an outside surface of glass 29 of the sash 2 can be cleaned safely and easily from the inside of the room.

The cylindrical portion 18 has a shaft supporting bore 31 passing through the up-and-down direction thereof, and an enlarged opening 31*a* communicating with the shaft supporting bore 31 (FIG. 7). An adjusting shaft 32 used as an adjusting means for the torsion spring 15, is rotatably inserted into the shaft supporting bore 31 and the enlarged opening 31*a*, and a shaft portion 33 at the upper end of the adjusting shaft 32 projects upwardly from the cylindrical portion 18 and a part of a shaft portion 34 at the lower end projects downwardly from the cylindrical portion 18 (FIG. 7).

The adjusting shaft 32 is formed to have the same diameter at a lower shaft portion 35 which fits to the shaft supporting bore 31 of the cylindrical portion 18 and shaft portion 33 at the upper end, and a shaft portion 34 lower than the shaft supporting bore 31, has a larger diameter than the shaft supporting bore 31 and the shaft portion 35 (FIG. 7).

When the adjusting shaft 32 is inserted into the shaft supporting bore 31 from the lower section, a shoulder portion 36 between the shaft portions 34, 35 is caused to abut a shoulder portion 37 between the shaft supporting bore 31 and the enlarged opening 31*a* to prevent the upward movement of the adjusting shaft 32 (FIG. 7). An annular groove 39 of the adjusting shaft 32, located at the edge of an upper end 38 of the shaft supporting bore 31, has a stop ring 40 fitted therein, so that the downward movement of the adjusting shaft 32 is prevented. By this structure, the adjusting shaft 32 is assembled within the shaft supporting bore 31 in such a manner that it will only rotate (FIG. 7).

Figure 3:
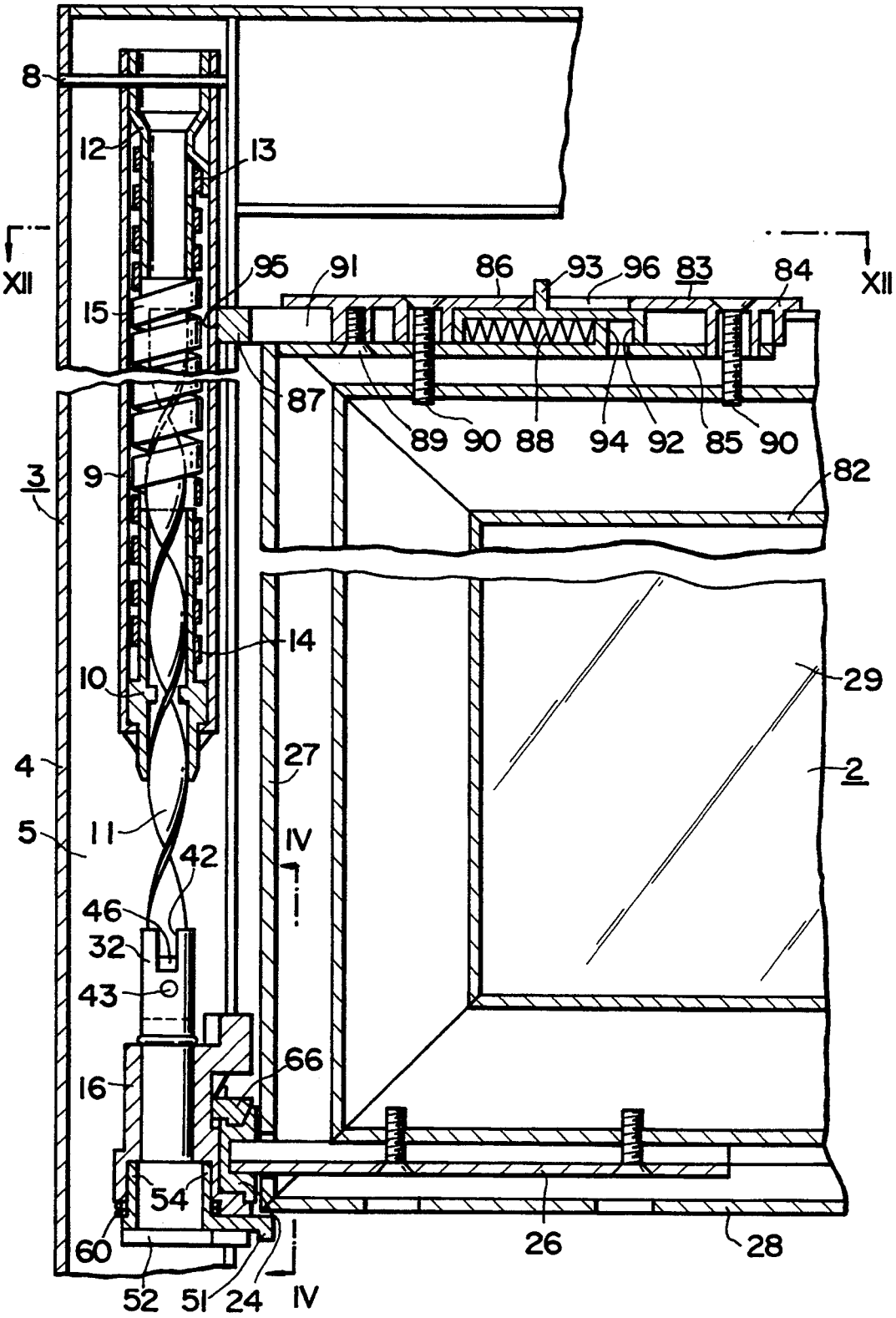
FIG. 3 is a sectional view taken along section line III—III of FIG. 2, wherein an inner window sash is drawn upwardly to a raised position.

The adjusting shaft 32 is provided with cross-shaped slits 41, 42 at its upper end (FIGS. 5 and 6). Into the slit 41, the lower end of the spiral member 11 is inserted, and these are connected with a cross screw 43 whose head is screwed in a screw bore 45*a* through a bore 44 at the lower end of the spiral member and a bore 45 of the adjusting shaft 32. Into another slit 42, a pin 46 fixed to the spiral member 11 at a right angle, is inserted, and the pin 46 serves to fix the positions of the bore 44 of the spiral member 11 and the bores 45, 45*a* of the adjusting shaft 32, and prevents the rotation of the spiral member 11 relative to the adjusting shaft 32. By this structure, the adjusting shaft 32 is hung from the spiral member 11, and hangs the sliding block 16, whereby the sliding block 16 supports a sash 2 by way of the pivot shaft 24 and the connecting arm 26, and the sash 2 is hung by way of the counter balance 7 (FIG. 3).

An adjusting means for the torsion force of the torsion spring 15 of the counter balance 7 is provided with the above-mentioned adjusting shaft 32, as well as a braking members 50 imparting the braking force to the adjusting shaft 32 and cam faces 51 push the braking members 50 against the adjusting shaft 32 (FIG. 8).

For example, each of the braking members 50 is formed as an arcuate wedge shape, and four braking members are mounted integrally on a rotation ring 52 with equal intervals so that they surround the adjusting shaft 32, wherein a lever 53 extends in a radial direction from the rotation ring (FIG. 8).

Four cam faces 51 are formed with equal intervals on the inner periphery of the enlarged opening 31*a* of the sliding block 16 so that they correspond to the braking members 50 (FIG. 8). The cam faces 51 and outer faces 54 of the braking members 50 are in contact. The cam faces, are formed into an arcuate shape wherein the radius increases in a peripheral direction, and the length of the arc at the outer surface 54 is shorter than that of the cam face 51, whereby sliding can be made with a play. Each of inner surfaces 55 of the braking members 50 is formed into an arcuate shape so that it can be brought into close contact with the peripheral surface of the shaft portion 34 of the adjusting shaft 32.

The braking members 50 are inserted into the enlarged opening 31*a* surrounded with cam faces 51. The shaft portion 34 of the adjusting shaft 32 is inserted into an opening 56 surrounded with the braking members 50 and into the ring 52 (FIG. 8), and the lever 53 passes through a slot 57 formed on the rectangular portion 17 of the sliding block 16 and projects outwardly from the flat surface 22 (FIG. 5).

The lever 53 is slidable between end portions 58, 59 of the slot 57 (FIG. 5). When the lever 53 abuts an end portion 58 of the slot 57 (FIG. 9), the outer surfaces 54 of the braking members 50 are not being pushed against the cam faces 51, and the braking members are in the neutral condition. Thus, the inner surfaces 55 of the braking members 50 are not pushed against the adjusting shaft 32 and the adjusting shaft 32 is in the condition free from braking force. Further, when the lever 53 is rotated to the position where the lever abuts the other end portion 59 of the slot 57 in a direction opposite to the arrow A, the outer surfaces 54 of the braking members 50 are pushed by the cam faces 51, whereby the adjusting shaft 32 is clamped torsionally by the inner surfaces 55 of the braking members 50, such being the braking condition (FIG. 9).

Figure 9:
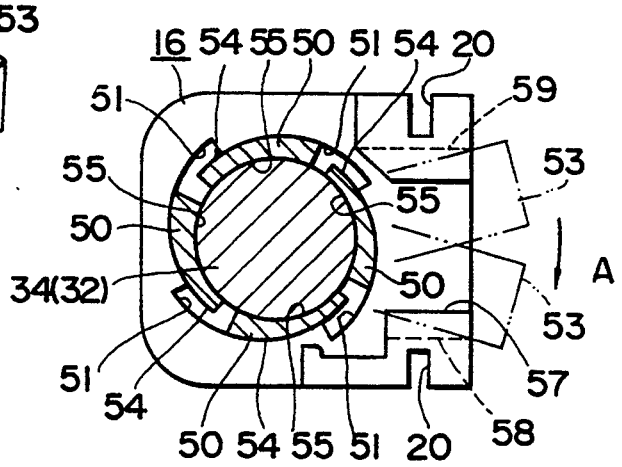
FIG. 9 is a sectional view taken along section line IX—IX of FIG. 7.

A coiled torsion spring 60 is wound around the outer periphery of the braking members 50 (FIG. 7), and has an end portion 61 hooking the lever 53 and another end portion 62 hooking the end portion 58 of the slot 57 (FIG. 8), to apply a rotation force to the braking members 50 in a direction of braking (direction opposite to the arrow A), thereby maintaining the braking condition of the adjusting shaft 32 (FIG. 9).

The adjusting member 32 has a slot 63 at the lower end, and a head of a screwdriver is inserted into the slot 63 for rotation. When the adjusting shaft 32 is turned clockwise (direction of the arrow A), the torsion force of the torsion spring 15 increases, and when turned counter-clockwise (direction opposite to the arrow A), the torsion force decreases.

The adjustment of increasing the torsion force of the torsion spring 15 is made as described below. Under the condition of FIG. 9, namely the condition wherein the braking members 50 are in close contact with the shaft portion 34 of the adjusting shaft 32 and the cam faces 51, when the adjusting shaft 32 is rotated clockwise (direction of the arrow A), the braking members 50 are also rotated in a circumferential direction to remove the braking force. Consequently, the adjusting shaft 32 is rotated clockwise to wind up the torsion spring 15. When the torsion spring 15 is wound up to a predetermined amount, the force of hand for rotating the adjusting shaft 32 in a winding-up direction, is removed, whereupon the adjusting shaft 32 is a little returned counter-clockwise (direction opposite to the arrow A) by the torsion spring 15, and at the same time, the braking members 50 rotate in the same direction to apply braking force against the adjusting shaft, thereby preventing the rotation in the return direction.

The adjustment of decreasing the torsion force of the torsion spring 15 is made as described below. Under the condition of FIG. 9, while preventing the counter-clockwise rotation (direction opposite to the arrow A) of the adjusting shaft 32 by manual force, the lever 53 is rotated from the end portion 59 of the slot 57 toward the end portion 58 to remove the braking force of the braking members 50. Under this condition, manual force acting on the adjusting shaft 32 is decreased, whereupon the adjusting shaft 32 is gradually rotated counter-clockwise by the force of the spring 15 to decrease the force of the spring 15. When the force of the spring 15 is decreased to a predetermined amount, the lever 53 is returned to the end portion 59 of the slot 57 by the spring 60, whereupon the braking force of the braking members 50 acts on the adjusting shaft 32 to prevent the rotation of the adjusting shaft.

The unwinding of the torsion spring 15 may be made only by removing the braking force against the adjusting shaft 32 by the operation of the lever 53. As described above, the torsion force of the torsion spring 15 is adjusted so that it may properly counter balance the sash.

The following description will be made with respect to a second braking means which imparts automatically a braking force as the window sash is being inclined to hold the inclined window sash at a position of a desired height.

The second braking means is mainly comprised of a braking shoe 66 and the pivot shaft 24 which rotates the braking shoe (FIG. 5), and these members are incorporated within the first sliding block 16 as described below.

For the incorporation, the first sliding block 16 has a transverse slot 65 formed on a flat surface 22 of the rectangular portion 17 (FIG. 5), both ends of the slot 65 open on the flat surfaces 19 of the both sides of the sliding block 16, and the center part of the slot 65 communicates with the shaft supporting bore 23 (FIG. 9). The brake shoe, 66 is inserted into the transverse slot 65 and the pivot shaft 24 is inserted into the shaft supporting bore 23, whereby the rotation of the pivot shaft 24 moves the brake shoe 66 to the braking position.

Figure 10:
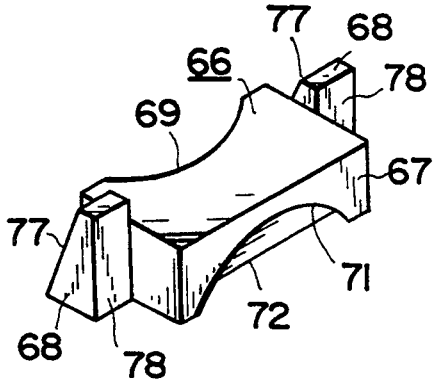
FIG. 10 is an exploded perspective view showing a braking means for the first sliding block.

The brake shoe 66 is, as shown in FIG. 10, provided with a rectangular portion 67 and brake portions 68 of substantially right-angled triangle shape, disposed integrally on and projecting from the both sides of the rectangular portion 67. The rectangular portion 67 has an arcuate surface 69 which fits to the cylindrical portion 18 of the sliding block 16, an arcuate surface 71 which fits to a flange 70 of the pivot shaft 24, and a cam receiving surface 72 of a flat horizontal shape.

The pivot shaft 24 has circular surface 73, a flat surface 74 which is a partially-cutaway flat portion of the circular surface 73, and a flange 76 at the back end of the flat surface 74 (FIG. 10). A cam face 75 of the pivot shaft 24 is fitted to the cam receiving surface 72 of the brake shoe 66, to move the brake shoe 66 upwardly and downwardly in accordance with the rotation of the pivot shaft 24 (FIG. 7). The flange 76 of the pivot shaft 24 is fitted to the back surface of the cam receiving surface 72 to hold the pivot shaft 24 such that the shaft is permitted to only rotate (FIG. 7).

Figure 11:
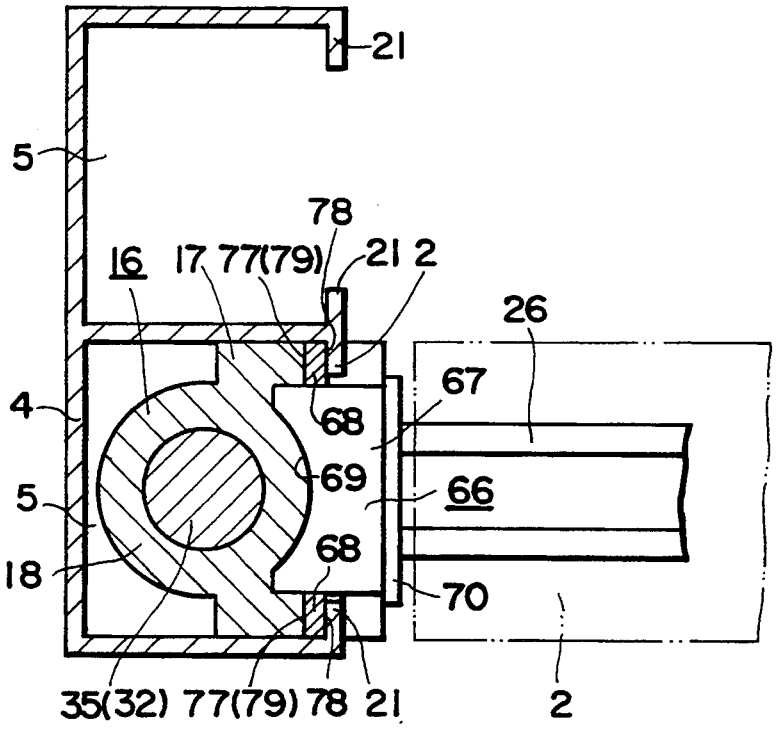
FIG. 11 is a sectional view taken along section line XI—XI of FIG. 7.

The brake shoe 68 has an inclined sliding face 77 and a perpendicular brake face 78 (FIG. 10). The sliding face 77 is engaged with an inclined guide face 79 at the inner part of the slot 65 (FIG. 5), and the guide face 79 pushes the brake shoe 66 forward as it is being raised, and guides the brake shoe rearward as it is being moved down. The above brake face 78 is present at the inner portion of one of sliding surfaces 80 of the sliding groove 20 of the first sliding block 16 as the brake shoe 66 is in downward movement (FIG. 5), and is in slight contact with or not in contact with the flange 21 of the side jamb 4 (FIG. 11). When the brake shoe 66 is being raised, the brake face 78 is pushed against the flange 21 of the side jamb 4 to impart braking force to the first sliding block 16, thereby preventing the up-and-down movement of the sliding block 16 (FIG. 11). By this structure, when the sash 2 is inclined from the vertical position to the horizontal position (FIG. 4), braking force will be given to the sash to hold the sash at the horizontal position.

Figure 12:
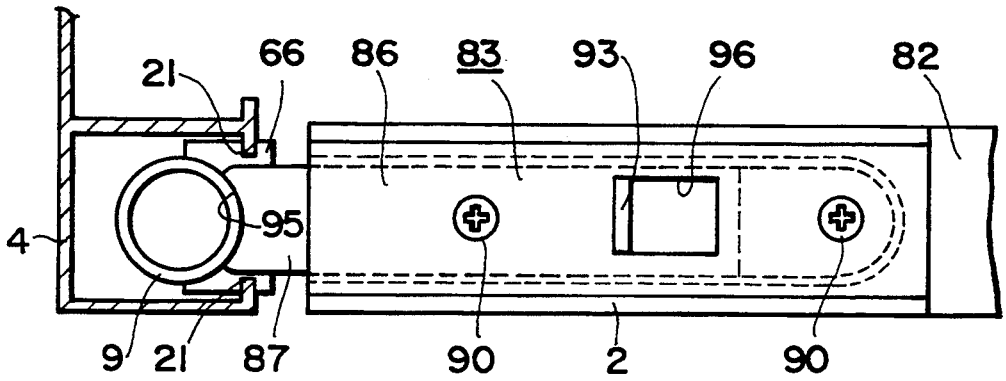
FIG. 12 is a sectional view taken along section line XII—XII of FIG. 3.

The sashes 1, 2 are provided with locking means at top rails 82, 82 to prevent the rotation of the sash around the pivot shaft 24 by locking the locking means, and permit the rotation of the sash by unlocking the locking means. A locking member 83 as the locking means, is provided with a housing 86 comprised of a housing body 84 and a bottom cover 85 for closing the opening at the bottom, and a latch 87 slidably inserted into the housing and a compression coiled spring 88 biasing the latch 87 toward the direction of projection (FIGS. 3 and 12).

The housing body 84 and the bottom cover 85 are connected with a screw 89, and fastened to the top rail 82 by a screw 90. The latch 87 has an elongated slot 91, a recess 92 and a knob 93. The elongated slot 91 surrounds screws 89, 90 to define the stroke of the latch 87. Into the recess 92, the spring 88 is incorporated, and one end of the spring is engaged with the wall face of the recess 92 and the other end of the spring is engaged with a bent portion 94 of the bottom cover 85 to permit the latch to project.

A front end 95 of the latch 87 is formed into an arcuate shape (FIG. 12) and the front end is fitted to the tube 9 and moves upward and downward with the sashes 1, 2 along the tube as a guide face. The latch 87 is clamped with flanges 21, 21 of the side jamb 4 of the window frame (FIG. 12), to prevent the inclined movement of the sashes 1, 2. The knob 93 projects upward from an elongated slot 96 of the housing body 84 and returns the latch 87 back to the drawn back position. In such a rearward movement, the latch 87 moves outward from the position at which it engages with the flange 21 of the side jamb 4 of the window frame, whereby it is unlocked to permit the sash 2 to be inclined.

Figures 13, 14:
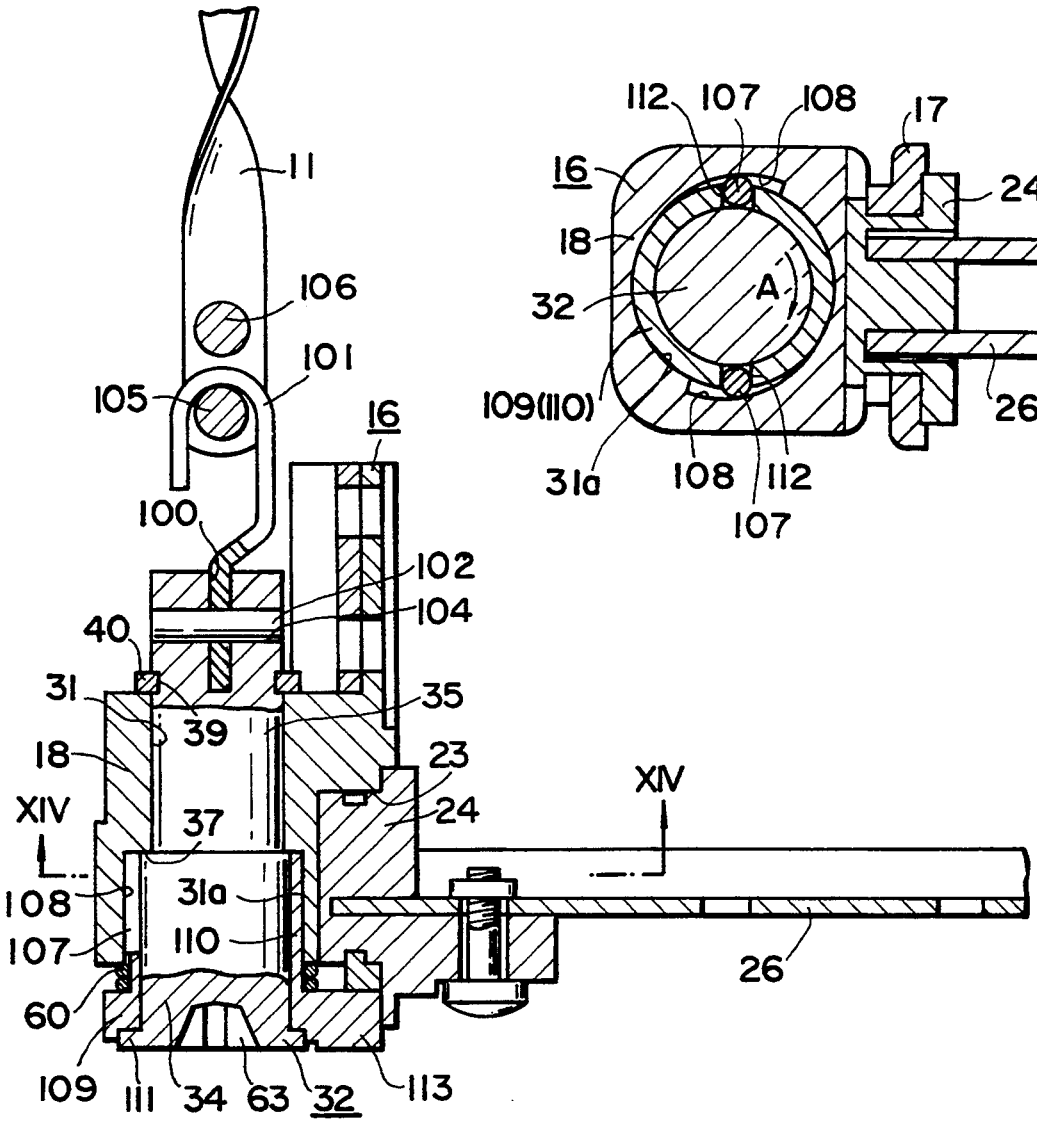
FIG. 13 is a sectional view similar to FIG. 7, showing another example.
FIG. 14 is a sectional view taken along section line XIV—XIV of FIG. 13.

As a second embodiment of the connecting means between the adjusting shaft 32 and the spiral member 11, as shown in FIG. 13, the adjusting shaft 32 has a slit 100 at the upper end, the lower end of a hook 101 is inserted into the slit, and a cross pin 102 is inserted through an opening 103 of the slit 100 and a transverse opening 104 of the adjusting shaft 32 for connection. The hook 101 is connected to the spiral member 11 with a pin 105 and a pin 106. By this connecting means, the connection and separation of the adjusting shaft 32 and the spiral member 11 can be made readily, whereby the counterbalance can be replaced readily.

As a second embodiment of the adjusting means for the torsion force of the torsion spring 15, as shown in FIG. 14, a braking member 107 is formed into a cylindrical roller shape, and two braking members 107 are positioned around the adjusting shaft 32 with equal intervals, and two cam faces 108 surrounding these braking members 107 are formed on the inner surface of the enlarged openings 31*a* of the first sliding block 16 with equal intervals so that they correspond to the braking members 107. Each of cam faces 108 is formed into an arcuate shape such that the radius increases in the circumferential direction, like the cam faces 51 in the first embodiment. A retainer 109 has a tubular portion 110, and the tubular portion 110 is fitted to the enlarged shaft portion 34 of the adjusting shaft 32 and the enlarged opening 31*a* of the sliding block 16. The upper end of the tubular portion 110 is engaged with the shoulder portion 37 of the shaft supporting bore 23, and the lower end thereof is engaged with a flange 111 of the adjusting shaft 32 to prevent the upward movement of the adjusting shaft 32 (FIG. 13). The tubular portion 110 has a vertical slot 112 around the circumferential wall, and the braking member 107 of a cylindrical roller is inserted into the slot 112. The retainer 109 has a lever 113 extending in a radius direction from the tubular portion 110, and slides between two stoppers 114, 115 at the bottom surface of the first sliding block 16. When the lever 113 abuts to the stopper 115, the braking member 107 takes the deepest position of the cam face 108 and is in the neutral condition, wherein the braking member 107 is not pushed against the adjusting shaft 32 and the adjusting shaft 32 is not in the braking condition. When the lever 113 is rotated to the position at which it abuts to another stopper 114 in the direction opposite to the arrow A, the braking member 107 is pushed by the cam face 108 and imparts braking force to the adjusting shaft 32. The coiled torsion spring 60 in engaged with the tubular portion 110 of the retainer 109, and one end of the spring is hooked on the side of the retainer 109, and the other end is hooked on the side of the first sliding block 16, whereby rotation force is always given in a direction of braking the retainer 109 to retain the braking condition of the adjusting shaft 32. The adjusting means is operated in such a manner like the first embodiment.

Figure 16:
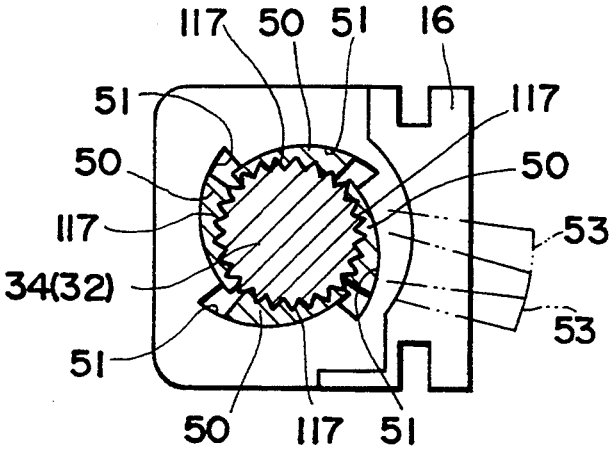
FIG. 16 is a sectional view similar to FIG. 9, showing another example.
Figure 17:
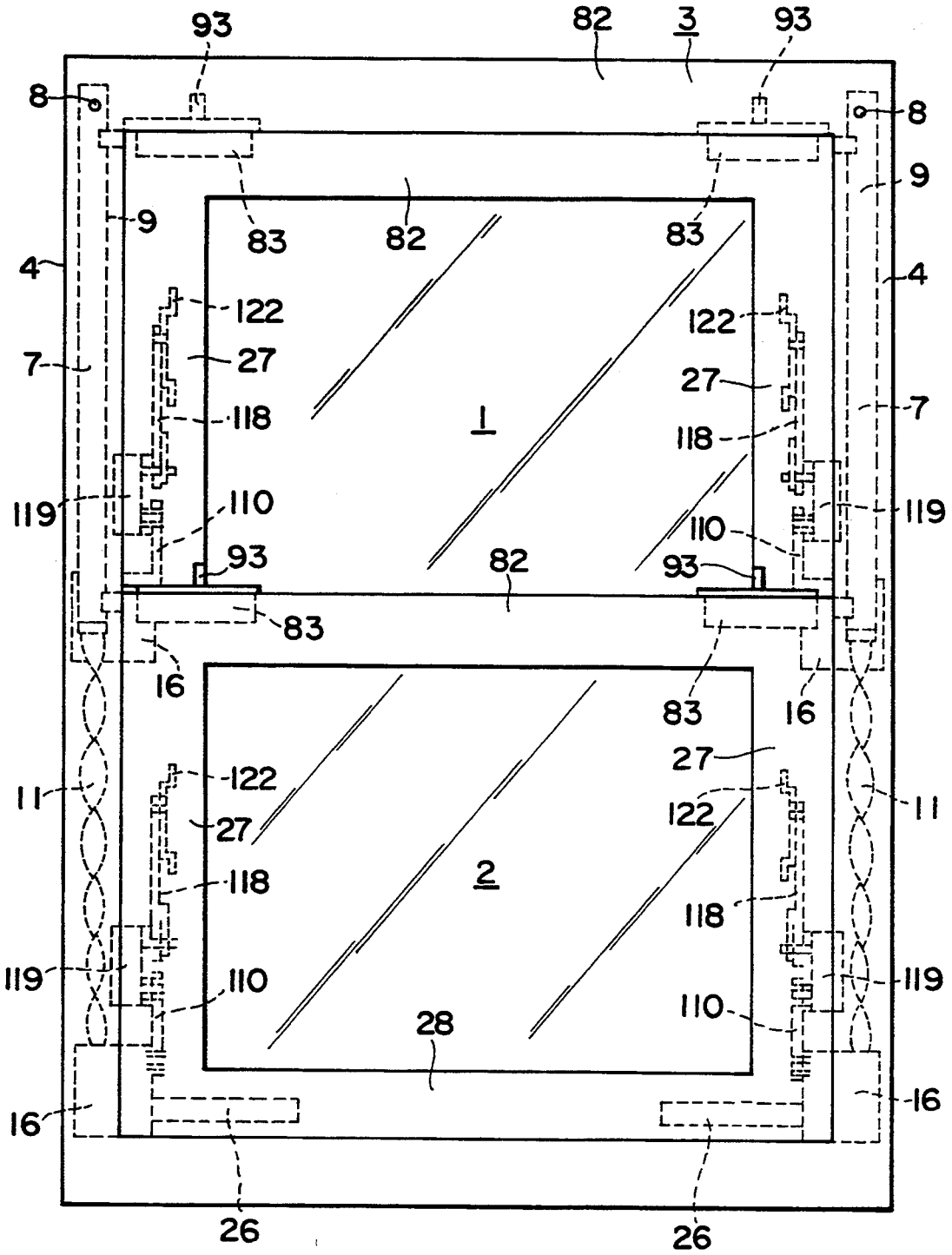
FIG. 17 is a front elevation view of a window, showing another example.

As a third embodiment of the adjusting means for the torsion force of the torsion spring 15, as shown in FIG. 16, each of the arcuate wedge-shaped braking members 50 has internal recesses and the enlarged shaft portion 34 of the adjusting shaft 32, is provided with peripheral corrugations or projections 117 circumferentially thereof received in corresponding recesses of the wedge-shaped braking members 50 by which they engage with each other at the contact surface there of. By this structure, a stronger braking force may be obtained.

Next, an arm 118 retaining the window sash 2 in the downwardly and inwardly swung condition, will be described.

Figure 18:
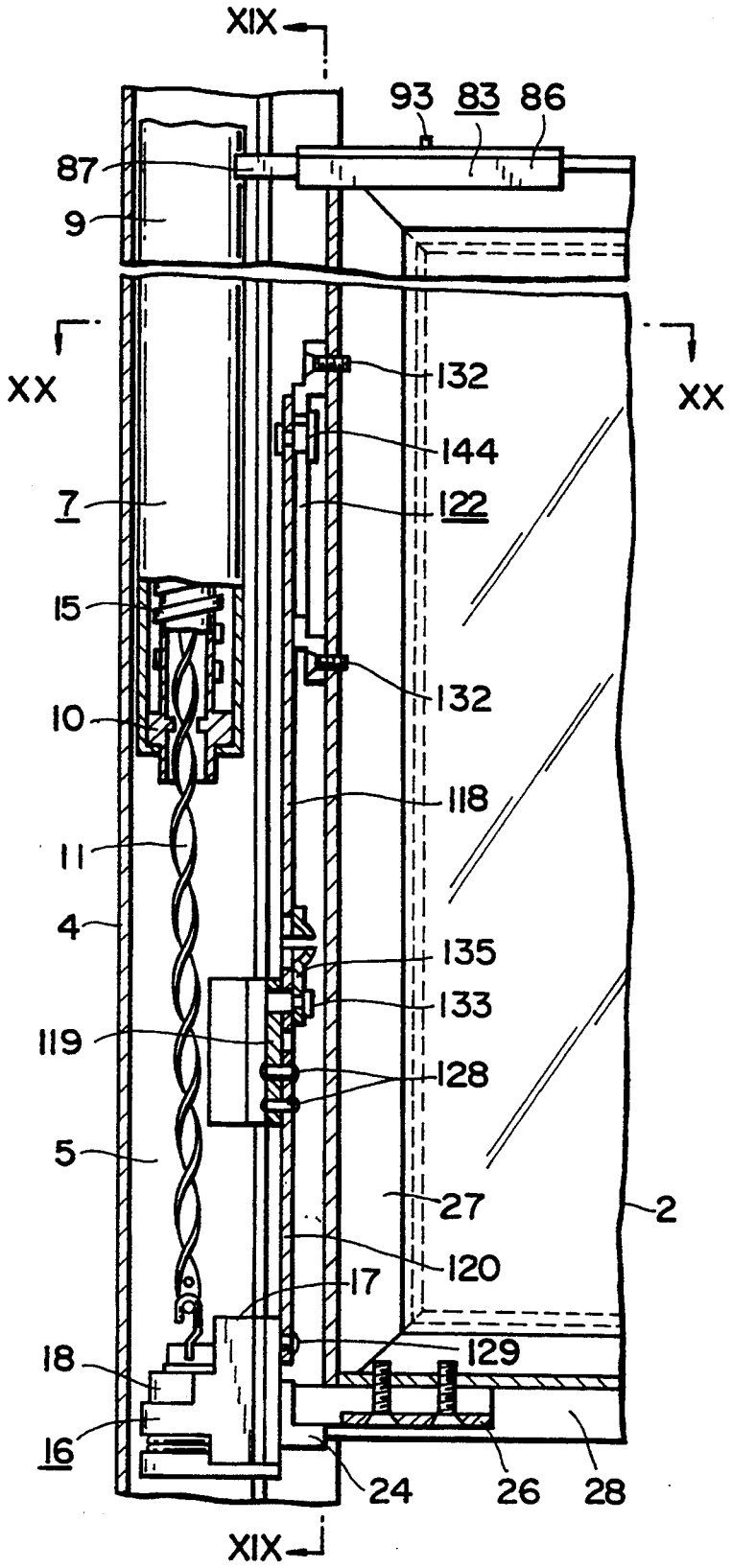
FIG. 18 is a sectional view similar to FIG. 3, showing the window sash of FIG. 17.
Figure 19:
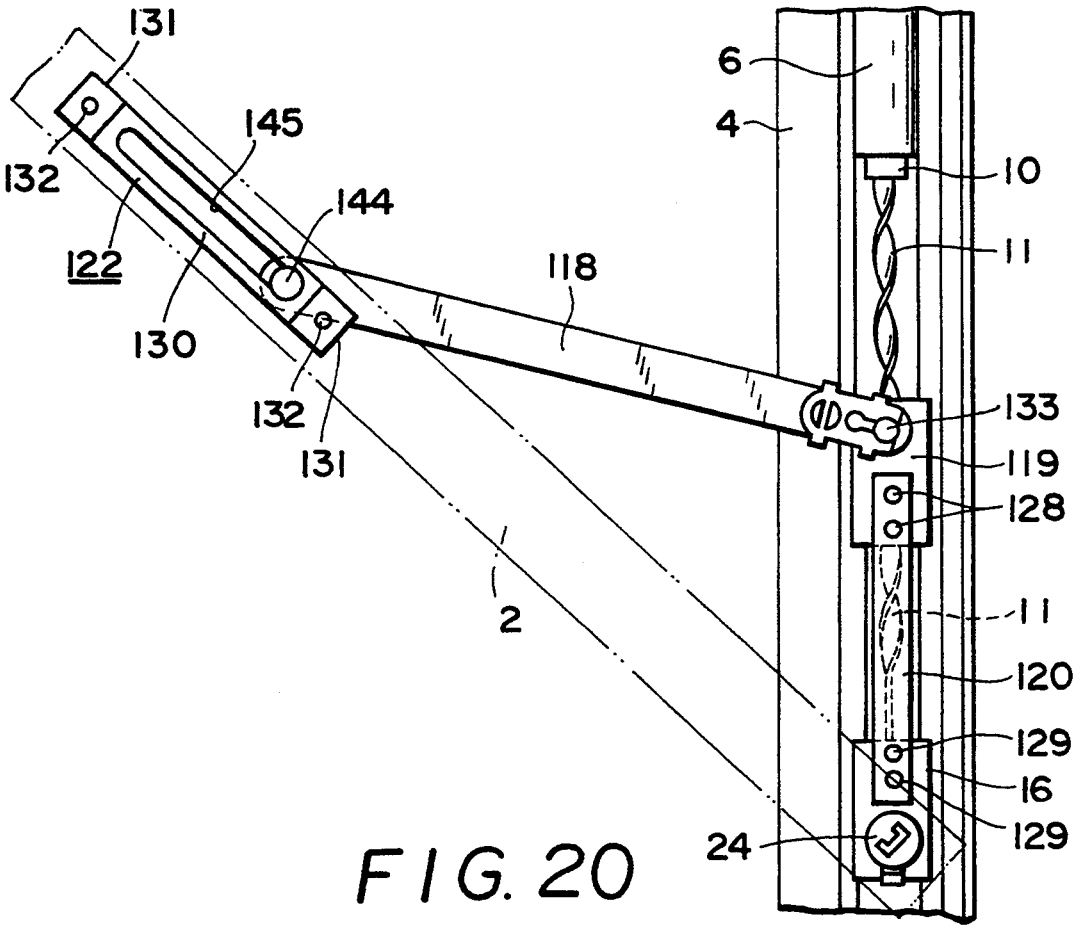
FIG. 19 is a sectional view taken along section line XIX—XIX of FIG. 18, showing the condition that the window sash of FIG. 17 is opened.

The window sash 2 slides around the pivot shaft 24 of the first sliding block 16 from the vertical and closed position to the inwardly inclined position (FIG. 18). The sliding block 16 is basically the same as those which have been described, and thus is hung from the spiral member 11 of the counter balance 6. Above the sliding block 16, a second sliding bock 119 is disposed, and these sliding blocks are integrally connected to each other with a connecting flat bar 120 (FIG. 18). The sliding block 16 moves upwardly and downwardly within the guide groove 5 of the side jamb 4 of the window frame, and the second sliding block 119 moves upwardly and downwardly along the flange 21 of the opening of the side jamb 4 (FIG. 19).

Figure 20:
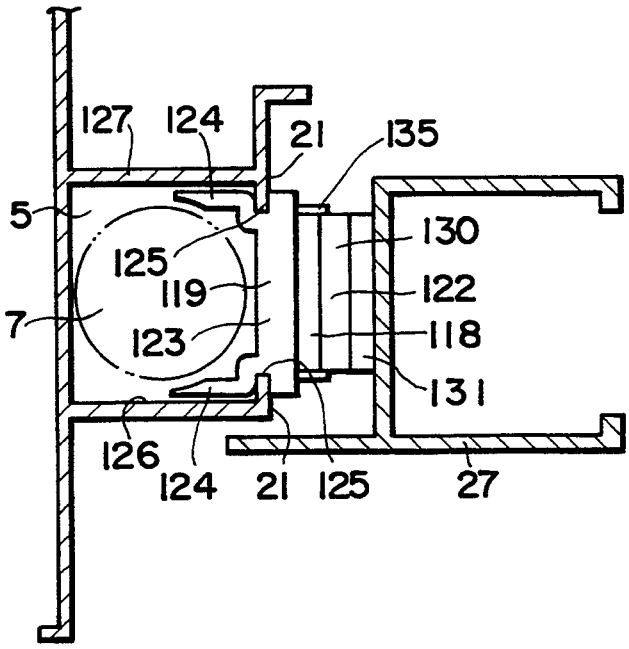
FIG. 20 is a sectional view taken along section line XX—XX of FIG. 18.

An end portion of the arm 118 pivotally mounted on the second sliding block 119 by a first connecting means, and the other end portion is connected to a mounting plate 122 fixed on the side surface of the window sash 2 in such a relation that it would be moved linearly while rotating by way of a second connecting means (FIG. 18). The second sliding block 119 has a rectangular plate portion 123 and leg portions 124 extending from both sides of said plate at a right angle (FIG. 20). Sliding slots 125 formed at roots of leg portions 124 are slidably fitted to the flange 21 at the opening surface of the side jamb 4 of the window frame, and the second sliding bock 119 is moved upwardly and downwardly along the side jamb 4 (FIG. 19). The leg portions 124 slide on wall portions 126, 127 of the guide groove 5, whereby the up-and-down movement of the second sliding block 119 may be made further smoothly (FIG. 19). The upper end of the strip-like connecting flat bar 120 is fixed to the plate portion 123 with rivets 128, and the lower end of the connecting flat bar is fixed to the rectangular portion 17 of the sliding block 16 with rivets 129 (FIG. 18), whereby the first and second sliding blocks 16, 119 are integrally moved upwardly and downwardly as described above.

The mounting plate 122 has a rectangular risen plate portion 130 and, at both ends, leg portions 131 each formed into a shape having a difference in level, wherein leg portions 131 are fixed to the side stile 27 with screws 132 in such a manner that the longitudinal direction of the raised plate portion 130 would be directed toward the longitudinal direction of the side stile 27 of the window sash (FIG. 18).

The first connecting means used for pivotally mounting in a detachable fashion, one end of the strip-like arm 118 on the second sliding block 119 is provided with a first pin 133 standing on the plate portion 123 of the sliding block 119, a first opening 134 bored at one end of the arm 118, being detachably fitted to the pin 133, and a clip 135 for preventing the disengagement of the first opening 134 from the pin 133 (FIG. 20).

The pin 133 has an annular groove 136, and when the pin 133 passes through and projects from the first opening 134, the annular groove will be present at such a position that it comes out of the first opening 134. The clip 135 is slidably disposed on the arm 118 with its holding portion 137, and has, at the end, a circular partial opening 138 exceeding 180 degrees (FIG. 20). As the clip 135 proceeds forward, the partial opening 138 is engaged with the annular groove 136 of the pin 133 to retain the connection of the pin 133 with the arm 118, and when the clip 135 moves rearward, the partial opening 138 will be disengaged from the groove 136 to disconnect the arm 118 and the pin 133.

Figure 21:
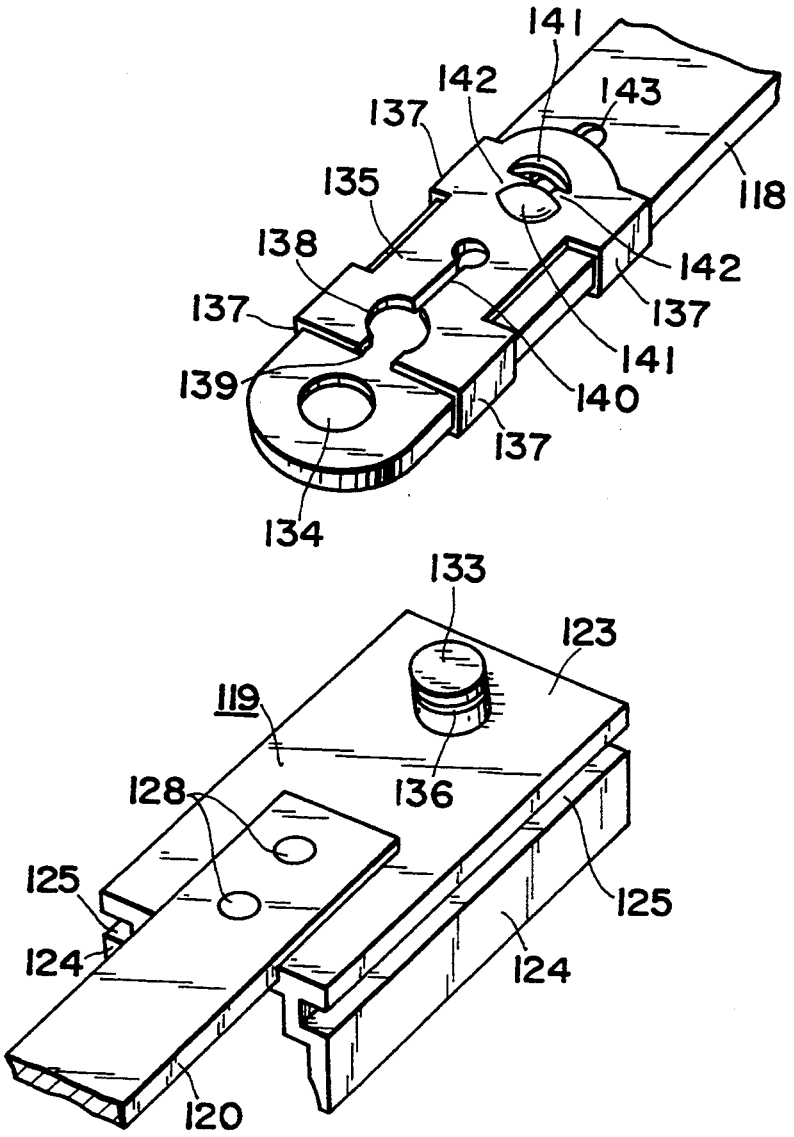
FIG. 21 is a perspective view showing a connecting means for the second sliding block and the arm in the present invention.

In FIG. 21, the arc of the partial opening 138 exceeds 180 degrees, and the size of an opened portion 139 of the partial opening is smaller than the diameter of the annular groove 136 of the pin 133. When the partial opening 138 is pushed into the annular groove 136 for engagement, the engaged condition will be kept. When an elongated slit 140 is communicated with the partial opening 138, the opened portion 139 of the partial opening 138 will be enlarged readily against the resilience, whereby attachment and detachment of the clip 135 to the pin 133 is made readily. The clip 135 further has hemisphere raised portions 141, 141 at the rear end, and strip-like bent portions 142, 142 bending downwardly. By pushing the raised portion 141 with the head of a screwdriver, the clip 135 is moved forward or rearward, and by inserting the bent portion 142 into an elongated slot 143 of the arm 118, the clip 135 will not be separated from the arm 121.

The second connecting means used for connecting the other end of the arm 118 to the mounting plate 122, has a second pin 144 standing on the arm 118, and an elongated slot 145 of a vertical direction, which is bored in the raised plate portion 130 of the mounting plate 122 and is to be fitted to the pin 144. The pin and the slot proceed linearly while rotating relatively (FIG. 19).

The arm 118 slides around the pin 133 in accordance with the slidable movement around the pivot shaft 24 of the sash 2. When the sash 2 is opened inwardly in the inclined condition, the pin 144 abuts to the lower end of an elongated slot 145 thereby retaining the sash at that position. When the sash 2 is closed from that position to the vertical position, the pin 144 moves toward the upper end of the elongated slot 145 along the elongated slot, and the arms 118 are folded such that they are in parallel with the both sides of the sash 2.

In the counterbalance 6, the braking means preventing the up-and-down movement thereof may be omitted.

We claim:

1. A window comprising, a window frame having a head and sill oppositely disposed, and side jambs oppositely disposed; a window sash slidable upwardly and downwardly along the side jambs of the window frame; a counterbalance having a coiled torsion spring counter balancing the window sash for keeping the window sash in a desired position; a first sliding block connected to the counterbalance and the window sash and slidable upwardly and downwardly along a side jamb of the window frame; adjusting means on said first sliding block for adjusting a counter balancing force of the torsion spring; and said adjusting means comprising an adjusting shaft rotatably mounted on said first sliding block for variably adjusting torsion of said torsion spring to adjust the counter balancing force of the torsion spring, means on said first sliding block for defining a cam face, a selectively operable braking member disposed rotatable circumferentially of said rotatable adjusting shaft and having a surface selectively coactive with said cam face; whereby when said braking member is selectively rotated said cam face applies said braking member against the rotatable adjusting shaft for braking said adjusting shaft, and said braking member is rotatable in an opposite direction for releasing said adjusting shaft for rotation.

2. A window according to claim 1, in which sliding block comprises a through bore, said rotatable adjusting shaft being disposed axially in said bore, said means for defining said cam face comprising said sliding block bore having said cam face therein, said adjusting means including a rotatable ring in said bore circumferentially of said adjusting shaft, said braking member being disposed on said rotatable ring between the adjusting shaft and said cam face, said braking member having a wedge shape coactive with said cam face, a lever for rotating said ring selectively operable in a direction for engaging said braking member and said cam face for effectively applying a braking force to said adjusting shaft and operable in an opposite direction for releasing the adjusting shaft from said braking force, and said adjusting means including a spring continuously biasing said ring rotationally in a direction for applying said braking force.

3. A window according to claim 1, in which ring has a plurality of braking members similar to the first-mentioned braking member, and said bore has a plurality of cam faces cooperative with said plurality of braking members for selectively applying said braking force and releasing said adjusting shaft from said braking force.

4. A window according to claim 3, in which said cam faces are arcuate, and said braking members have radially disposed arcuate surfaces coactive with said cam faces, and said arcuate surfaces have radii increasing in a circumferential direction.

5. A window according to claim 3, in which each of said braking members and said adjusting shaft have corrugated surfaces coactive in effectively braking said adjusting shaft when said lever is moved in a direction for applying said braking force.

6. A window according to claim 1, in which braking member is a cylindrical roller.

7. A window according to claim 6, in which said sliding block has a bore, said adjusting shaft extending axially in said bore, said means for defining said cam face comprises a surface of said bore, said braking member being disposed between the adjusting shaft and said cam face, a tubular retainer for said braking member disposed circumferentially of the adjusting shaft and rotatable relative thereto, a lever extending from said tubular retainer for selectively rotating said tubular retainer in a direction for engaging said braking member and said cam face for effectively applying a braking force to said adjusting shaft and operable in an opposite direction for releasing the adjusting shaft from said braking force, and said adjusting means including a spring constantly biasing said retainer rotationally in a direction for applying said braking force.

8. A window according to claim 7, including a plurality of cam faces disposed circumferentially in said bore and a plurality of said braking members disposed in said tubular retainer for coacting with said cam faces in effectively applying in said braking force.

9. A window according to claim 8, in which said cam faces are arcuate in shape and have a radius increasing in a circumferential direction.

10. A window according to claim 1, in which said counterbalance comprises a tube fixed to a side jamb of the window frame, said torsion spring extending axially in said tube and having an upper end fixed to the tube, a nut mounted on a lower end of the tube for rotation only and connected to a lower end of the torsion spring, a spiral member coactive with said nut and extending axially in said tube and out of said tube through said nut for winding said torsion spring, means for connecting the spiral member to said adjusting shaft, whereby when the window sash is moved downwardly the torsion spring is wound by the spiral member increasing the tension force thereof to assist lifting of the window sash, when moved upwardly, and when the window sash is moved upwardly the wound torsion spring unwinds and rotates the spiral member in a direction for applying a force moving the window sash upwardly.

11. A window according to claim 10, in which said means for connecting the spiral member to the adjusting shaft comprises a hook connected to the adjusting shaft and a pin connected to the spiral member.

12. A window according to claim 11, in which said adjusting shaft comprises a slot at a lower end thereof for receiving a screwdriver, whereby the adjusting shaft is rotatable in a direction for increasing the torsion of the torsion spring.

13. A window according to claim 12, including a pivot shaft between the first sliding block and the window sash for inclining of the window sash relative to the horizontal when the window sash is raised, and a braking member for applying a braking force to the first sliding block in accordance with the rotation of the pivot shaft when the window sash is inclined away from the vertical toward the horizontal.

14. A window according to claim 13, including means for moving the braking member upwardly and downwardly in accordance with the rotation of the pivot shaft, said first sliding block having a slant guide face and the braking member having a sliding face slidable on the slant guide face for reciprocating the braking member in a horizontal direction between a braking position in which the braking member is pushed against the side jamb of the window frame and a position in which the pushing is released in accordance with up-and-down movement of the braking member.

15. A window according to claim 13, in which said first sliding block comprises braking means for automatically preventing up-and-down movement of the first sliding block when the window sash is inclined toward a horizontal direction.

16. A window according to claim 15, including releasable locking means disposed on a top rail of the window sash for preventing inclination of the window sash toward a horizontal direction when in a vertical position.

17. A window according to claim 16, in which said locking means comprises a housing fixed to said top rail of the window sash, a locking member slidable in opposite directions in said housing and having an arcuate end for releasably engaging said tube of the counterbalance, a spring biasing the locking member toward said tube, and a selectively actuated device for locking the locking member in a projected position engaged with said tube.

18. A window according to claim 1, in which said window comprises a second sliding block connected to the first sliding block and slidable upwardly and downwardly along a window side jamb, an arm having one end connected to the second sliding block, means for connecting said second sliding block to said first sliding block, means connected to another end of said arm for connecting said arm to said window sash for inclining of said window sash toward a horizontal direction and coactive with said arm for restricting an angle at which said window sash can be inclined relative to the vertical.

19. A window according to claim 18, including means for preventing undesired disengagement of said arm and said means for restricting the angle at which said window sash can be inclined relative to the vertical.

20. A window according to claim 19, including means for rendering ineffective said means for restricting the angle at which said window sash can be inclined relative to the vertical.

21. A window according to claim 20, in which said means connecting the first sliding block and the second sliding block comprises a connecting member, and said first sliding block is hung on said counterbalance.

* * * * *